US006533405B1

(12) United States Patent
Sleger

(10) Patent No.: US 6,533,405 B1
(45) Date of Patent: Mar. 18, 2003

(54) PRESERVING INKJET PRINT CARTRIDGE RELIABILITY WHILE PACKAGED

(75) Inventor: Roger R. Sleger, Eagle, ID (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 10/025,418

(22) Filed: Dec. 18, 2001

(51) Int. Cl.[7] ..... B41J 2/19
(52) U.S. Cl. ..... 347/92
(58) Field of Search ..... 347/84–87, 92; 206/701, 576

(56) References Cited

U.S. PATENT DOCUMENTS 4,432,004 A * 2/1984 Glattli ..... 347/28
4,911,571 A * 3/1990 Inoue et al. ..... 401/202
4,998,115 A 3/1991 Nevarez et al.
5,289,213 A * 2/1994 Murai et al. ..... 347/28
5,297,883 A * 3/1994 Ozu ..... 401/202
5,420,619 A 5/1995 Glassett et al.
5,450,112 A 9/1995 Scheffelin
5,602,577 A * 2/1997 Shibata et al. ..... 347/84
5,667,063 A * 9/1997 Abe ..... 206/204
5,700,315 A 12/1997 Wenzel
5,812,168 A 9/1998 Pawlowski, Jr. et al.
5,850,239 A 12/1998 Gentile
5,988,806 A 11/1999 Hall et al.
6,050,682 A 4/2000 Pawlowski, Jr. et al.
6,203,146 B1 3/2001 Pawlowski, Jr. et al.
6,464,339 B1 * 10/2002 Ardito ..... 347/49
2002/0060711 A1 * 5/2002 Ito et al. ..... 347/28

* cited by examiner

*Primary Examiner*—Judy Nguyen

(57) ABSTRACT

Packaging for enclosing an inkjet print cartridge that preserves the reliability and function of the cartridge by incorporating water vapor inside the packaging to inhibit the growth of bubbles under the sealing component or tape that covers the nozzle orifices during shipping or storage.

11 Claims, 3 Drawing Sheets

PRESERVING INKJET PRINT CARTRIDGE RELIABILITY WHILE PACKAGED

RELATED APPLICATIONS (Not applicable)

STATEMENT REGARDING FEDERALLY SPONSORED RESEARCH OR DEVELOPMENT (Not applicable)

FIELD OF THE INVENTION

This invention relates to the storage of inkjet print cartridges and a method for retaining the reliability of the cartridge during the storage of the cartridge.

BACKGROUND OF THE INVENTION

Ink-jet printers have become widely accepted as reliable and inexpensive means of high-quality printing. A typical ink-jet pen has a print head having a plurality of nozzles or orifices through which ink droplets are ejected. Adjacent to the nozzles are ink firing chambers where ink is stored prior to ejection. Ink is delivered to the firing chambers through ink channels in fluid communication with an ink supply. The ink supply may be, for example, contained in a reservoir associated with the printhead. During printing, ink located in the firing chamber is heated or vaporized by a heat transducer, such as a thin film resistor. Formation of the ink vapor bubble is known as nucleation. The rapid expansion of the vaporized ink forces a drop of ink out through the nozzle. The nozzle is constructed to direct the ink droplet upon the media surface to form a "dot" of a printed image.

One type of ink-jet printer includes a carriage that is reciprocated across a sheet of paper that is advanced through the printer. The reciprocating carriage holds a printhead very close to the paper. The printhead is controlled by the printer for selectively ejecting the ink drops from the printhead while the printhead is reciprocated or scanned across the paper, thereby to produce characters or another image on the paper.

In order to print effectively, the firing chambers and nozzles need to be "primed" with ink. Typically, priming includes moving ink into the firing chambers. Ink is moved to and held within the chambers and nozzles by capillary force. Priming does not occur spontaneously as ink is first added to a printhead. Air bubbles lodged in and around the firing chambers may act to prevent spontaneous priming. Priming tends to be even more problematic in printheads that store ink under a slight back pressure. As used herein, the term "back pressure" means a partial vacuum within the printhead. In such systems, the presence of a back pressure ensures ink is expelled only when the print head is activated (i.e., when ink is ejected). However, the slight back pressure is not so high as to impede the movement of ink into the firing chambers and nozzles.

A specific priming operation is usually provided to prime the print head of an ink-jet printer head. Such priming usually takes place in ink-jet printhead factories by inverting the printhead after the ink reservoir has been filled with ink and sucking air and ink through the printer head nozzles. Special low-water-loss packaging is then used to prevent nozzle dry-out in factory-primed printheads. Typically, a factory-primed printhead, once installed in a printer, is not designed for repriming in the event that one or more print head nozzles become de-primed.

Priming devices have been previously used with inkjet print cartridges to remove undesirable air from the ink firing chambers after it has already accumulated. For examples, see U.S. Pat. No. 4,998,115, entitled "Method and Apparatus for Priming an Ink Jet Pen"; U.S. Pat. No. 5,420,619 entitled "OnLine/Off-Line Primer For Ink Jet Cartridge"; and U.S. Pat. No. 5,850,239 entitled "Manual Selecting lnkjet Primer System." However, because packaged print cartridges sometimes remain in inventory for long periods of time before use, there is a need for preventive techniques which tend to inhibit the accumulation of air during the period after manufacturing and prior to initial use. In addition, many printers in the market do not have priming systems installed.

After priming of a print head there are inevitably small air bubbles in the printhead. Initially, these bubbles are very small and do not interfere with ink flow or otherwise compromise the function of the printhead. However, care must be taken to eliminate the growth of these air bubbles. The growth of air bubbles within the printhead is very undesirable, because the bubbles will grow to an extent that they lead to print quality problems. An air bubble can obstruct ink flow to particular firing chambers from which ink droplets are to be ejected. Air bubbles can cause irregularly shaped ink droplets or cause a print head to deprime resulting in complete failure of the print head. Consequently, ink-jet print heads should be substantially free of such bubbles to function as designed.

There have been attempts to reduce air in the printhead to prevent these bubbles. Measures have been taken to prevent introduction of air into the ink supply or reservoir of the printhead, which often occurs after the printhead has been installed on a printer. These measures have been successful in improved printing quality and print life of the printhead. However, these measures have ignored another avenue in which air is introduced into the printhead, which is through gas transfer through the nozzle-sealing component.

After priming at the factory, the printhead must be packaged so that it can be stored, shipped and otherwise travel through the avenues of commerce to the final user in a functional condition. Since the printhead may be first used several weeks or months after initial priming, it must be protected from air getting into the nozzles or ink supply that could cause bad print quality or cause the printhead to deprime. Any changes, even slow changes, that can lead to the accumulation of air can become a problem. For this reason, the packaging usually includes features to preserve the functionality of the printhead by inhibiting air from getting into the printhead and ink from getting out by the passage of ink through the nozzles. One such feature is a sealing component that usually comprises a flexible polymeric film with an adhesive surface that is adhered to the ink ejection area or orifices of the printhead to close off the nozzles. The function of the sealing component is threefold. First, the sealing component prevents ingestion of air through the nozzles that can occur during shock during transportation and handling. This air ingestion can lead to depriming. Second, the sealing component inhibits drying of ink in the nozzles, which can lead to crusting and full or partial nozzle malfunction. Drying can occur over the extended transportation and storage of the cartridge. Third, the sealing component inhibits unwanted ink ejection or leakage through the nozzles, which can occur from mechanical shock.

After application of the sealing component, the print cartridge, which comprises the printhead with sealing component and its ink supply reservoir, is then enclosed in a container made of a material to inhibit the passage of gas (water vapor) to prevent water loss and drying of the ink.

This system has been generally successful in maintaining printheads in operable condition, even after long periods of storage under varying pressure and temperature conditions. However, there is still a problem of air bubbles growing under the sealing component. Consequently, there is a need to extend the storage life of printheads by eliminating the growth of bubbles to a size that can compromise the functioning of the printhead.

While not being bound to a particularly theory, it is believed that these bubbles grow due to the difference in humidity conditions between the inner and outer surfaces of the sealing tape. While the polymeric materials are generally impervious to the passage of liquid, they do allow for the slow diffusion of gasses through the material, and this passage of gasses can lead to the growth of bubbles.

Reference is now made to FIG. 1, which a schematic diagram of an inkjet printhead 100 comprising nozzles 101 with nozzle orifices 102 in a nozzle surface in the form of a nozzle plate 107, firing chamber 105, and heat transducers 106. The firing chamber 105 communicates with an ink reservoir 120 (as shown in FIG. 2) by channels 108. Shown is a sealing component 53 covering the nozzle orifices 102 to prevent leakage during shipping. At the inside surface 51 of the sealing component or tape 53, the surface is contacted with liquid ink 103, which is there because of the priming process. There may also be small residual air bubbles 104 remaining after the priming and nozzle sealing process, such residual air bubbles are not initially large enough to cause a significant problem. The air in these bubbles is of a high humidity, i.e., near saturation with respect to water vapor, because of its direct contact with the ink, which is water based. The outside surface 55 of the sealing tape 53 is in contact with the air enclosed in the shipping container with the printhead. This air is usually atmospheric air that was sealed in the package during packaging, and is often quite dry, i.e., having a low concentration of water vapor. The result is a higher partial pressure of air on the outside 55 of the tape than on the inside 51. In addition, there is a higher partial pressure of water vapor on the inside 51 of the tape than on the outside 55. The difference between air and water partial pressures creates a driving force across the sealing tape 53 for air to diffuse through to the inside and water vapor to diffuse through to the outside. Since the polymeric materials that are used to make the tape are slightly permeable to these gasses, the driving force causes a flux of air and water resulting in water lost to the outside (which reduces the ink volume in the nozzle 101 and firing chamber) and air migration to the inside, which grows the small bubbles 104 in the nozzle 101 and firing chamber 105. These fluxes are very slow, but over an extended storage time, the cumulative result can lead to larger gas bubbles 111 from the growth of existing bubbles 104 under the tape. These larger gas bubbles 111 can be large enough to disable the function of the printhead. For example, if the storage period is long enough, these bubbles can grow sufficiently large to block or deprime the nozzle 101, firing chamber 105, or channel 108, and cause the printhead to malfunction when it is installed in the printer. These bubbles can also prevent the flow of ink by blockage of nozzles and channels, prevent the vaporization of the ink by blocking ink from filling the firing chamber, or lead to the loss of priming. When such occurs, the printhead is usually useless, as many users do not have the equipment to remove the bubbles and restore the printhead function. Many printers are not equipped to reprime the printheads, and even with printers that are equipped with primers, in a repriming operation bubbles can remain stuck in the printhead with ink just flowing around bubbles during repriming. The result is that these bubbles remain and continue to compromise the printhead function.

Since these bubbles are difficult to remove, and can cause serious problems, there is a need to prevent the growth of such bubbles altogether.

BRIEF SUMMARY OF THE INVENTION

An aspect of the invention is a packaging for an inkjet printer cartridge that comprises a printhead. The printhead comprise ink nozzles from which ink is ejected during the printing process when the cartridge is installed on a printer. The printhead is supplied by an ink reservoir chamber in fluid communication with a print head. Before installation in a printer, during storage and shipping, a sealing component with an inner surface adhesively attached to the nozzle plate at the inner surface is used.

The cartridge is enclosed in a shipping container with walls of a material to inhibit the passage of gas into or out of the container. The volume of the container is not filled exclusively by the print cartridge and also contains a space occupied by a gas, such as air. The gas is humidified with water vapor to inhibit the growth of gas bubbles at the inner surface of the sealing component and nozzles. The water vapor eliminates or suppresses the driving force, which causes the flux of air from the outside of the sealing component to the inside and of water from the inside to the outside. Without movement of water and air, the bubbles under the sealing component cannot grow.

The water vapor is present in any suitable amount to suppress the driving force, either saturated, or below saturated.

DETAILED DESCRIPTION OF THE INVENTION

The present invention can be used with any inkjet printhead technology in which a sealing component is used over a nozzle plate with nozzle orifices to seal the orifices. The present invention is particularly useful in thermal inkjet systems, but other inkjet systems using other technologies, such as piezo-electric, for example, are also contemplated. Printing systems using thermal inkjet technology basically involve an apparatus which includes at least one ink reservoir chamber in fluid communication with a substrate having a plurality of thin-film heating resistors or transducers thereon. The substrate and resistors are maintained within a structure which is conventionally characterized as a "printhead." Selective activation of the resistors causes thermal excitation of the ink materials stored inside the reservoir chamber and expulsion thereof from the printhead. Representative thermal inkjet systems are discussed in U.S. Pat. No. 4,500,895 to Buck et al.; U.S. Pat. No. 4,794,409 to Cowger et al.; U.S. Pat. No. 4,509,062 to Low et al.; U.S. Pat. No. 4,929,969 to Morris; U.S. Pat. No. 4,771,295 to Baker et al.; U.S. Pat. No. 5,278,584 to Keefe et al.; and the Hewlett-Packard Journal, Vol. 39, all of which are incorporated herein by reference.

Figure 1:
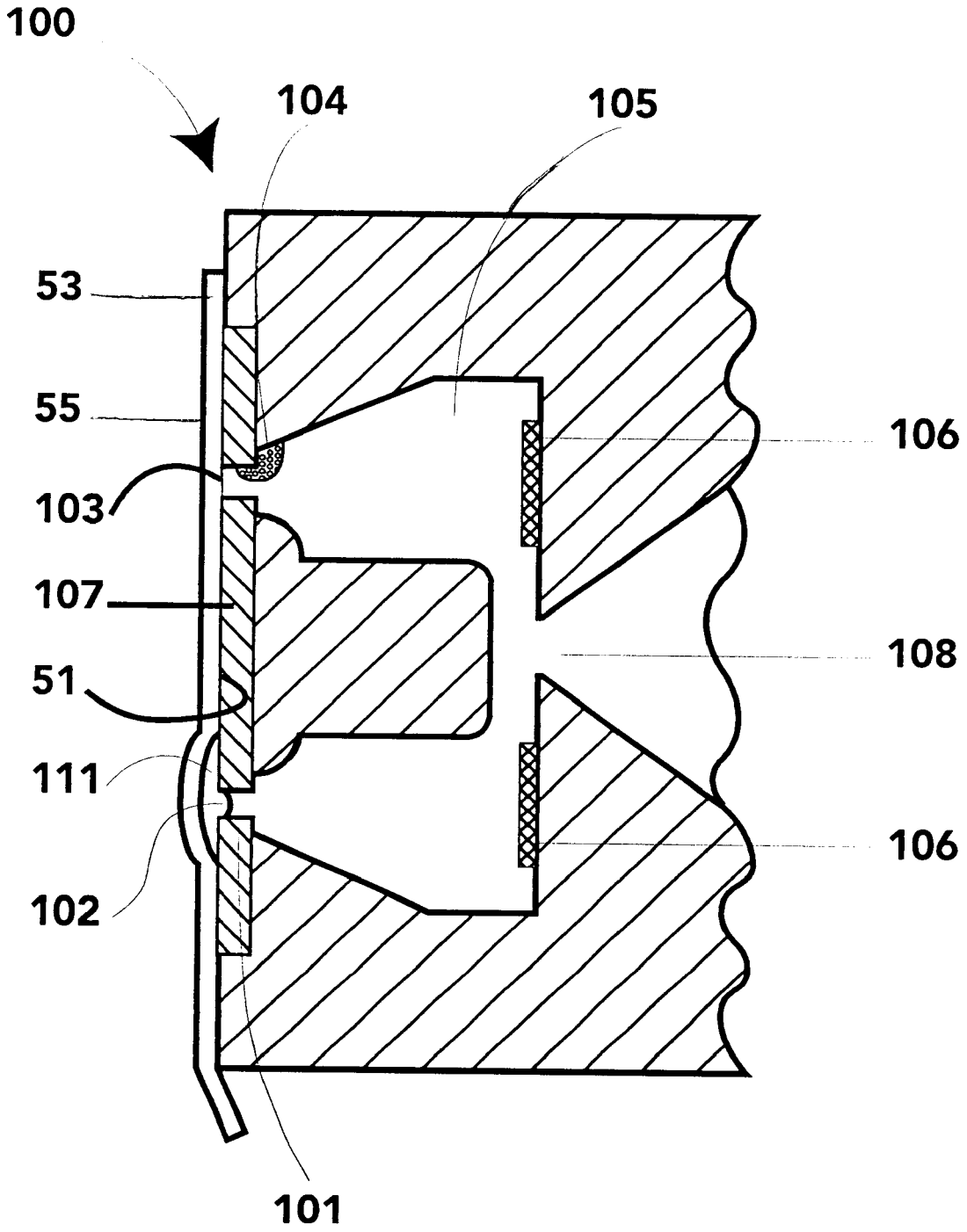
FIG. 1 is cross-sectional schematic diagram of a print head having a sealing component in the form of a flexible polymeric tape over the nozzles, illustrating the accumulation of bubbles under the tape.
Figure 2:
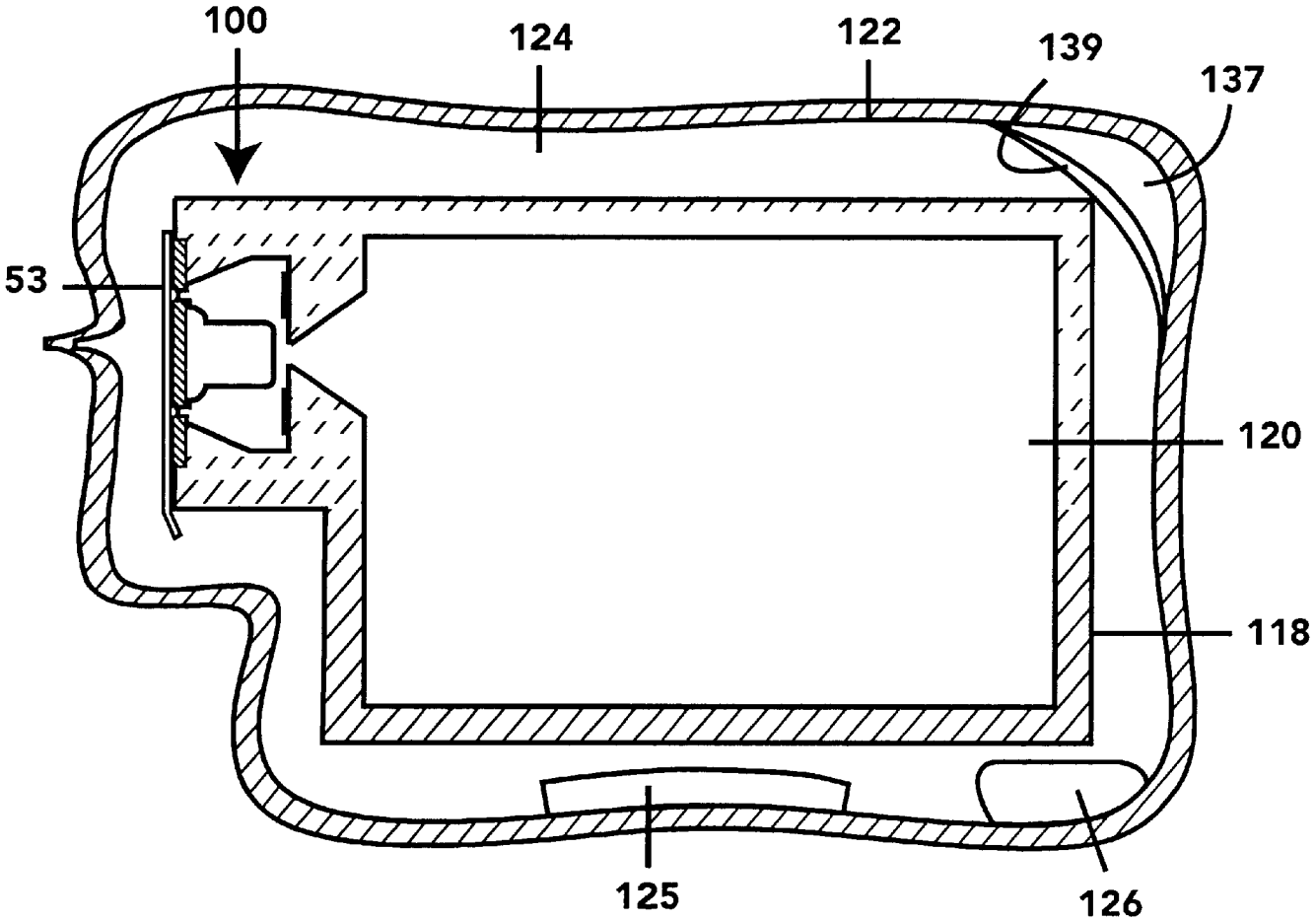
FIG. 2 is a cross-sectional schematic of a print-cartridge enclosed in a shipping container according to the invention.

Reference is again made to FIG. 1, which is a simplified illustration of a thermal inkjet printhead and also to FIG. 2, which is a schematic of a packaged printhead cartridge. When packaged for shipping, the inkjet cartridge 118, which comprises the printhead 100 with an ink supply reservoir 120 integrated as a unit into the cartridge 118, is enclosed in a shipping container 122. The shipping container 122 is oversized so that the cartridge does not completely fill the container. The remaining space is occupied by air space 124 containing a gas, usually air. To suppress the driving force that leads to the growth of gas bubbles under the sealing tape 53, the gas in the air space 124 contains water vapor sufficient to lower the driving force such that bubbles cannot grow significantly during shipping and storage of the packaged cartridge.

The gas is usually air, but may be any suitable gas such as nitrogen or any of the essentially inert gasses. The water vapor can be introduced into the gas by any suitable means. The gas can be pre-humidified to a predetermined value before the shipping container is filled with the gas. Liquid water can be injected into the shipping container with the cartridge before the shipping container is sealed. Alternately, the shipping bag may contain a water-vapor absorbent material that is preloaded with water, so that in the container it will expel water vapor into the gas. These materials include those usually used for drying. However, in this instance the material is preloaded with water to a substantial proportion of its loading capacity, such that in equilibrium, it will tend to humidify the air. Suitable materials include, for example, cellulosic materials (such as paper), and inorganic gels (such as silica gels). In FIG. 2, such an absorbent material 125 is shown adhered to the wall of the container 122. However, it may be left loose or otherwise structured such that it is in contact with the gas inside the container.

Referring again to FIG. 2, in one aspect of the invention, liquid water 126, can simply be sealed in the container with the cartridge. Any amount of water is suitable, but enough water to maintain a saturated humidity condition over the temperature range to which the packaged cartridge will be stored is preferred.

Alternately, water or any of the water containing absorbent materials may be contained in a side pocket 137 of the container 122. The side pocket 137 may be separated from the container by any suitable separator 139 that allows the passage of water vapor so the side pocket 137 is in water-vapor communication with the gas in the container 122. The separator 139 may be any material suitable known in the art, such as a membrane or wall that selectively allows the passage of water vapor to the exclusion of liquid water. Thus, there can always be a supply of water vapor to maintain a high humidity in the container without having water as a liquid in the container. Such a membrane can be any known small pore material that so functions, such as GORTEX™.

The amount of water vapor introduce into the container 122 depends on several factors, including the volume of the space containing the gas, the temperature conditions to which the packaged cartridge will be subjected, as well as the desired shelf life during which the growth of bubbles is to be prevented. If the gas is saturated with water vapor, the driving force toward bubble growth will be essentially nullified. This can be accomplished by having an excess of liquid water to which the gas is in contact.

Figure 3:
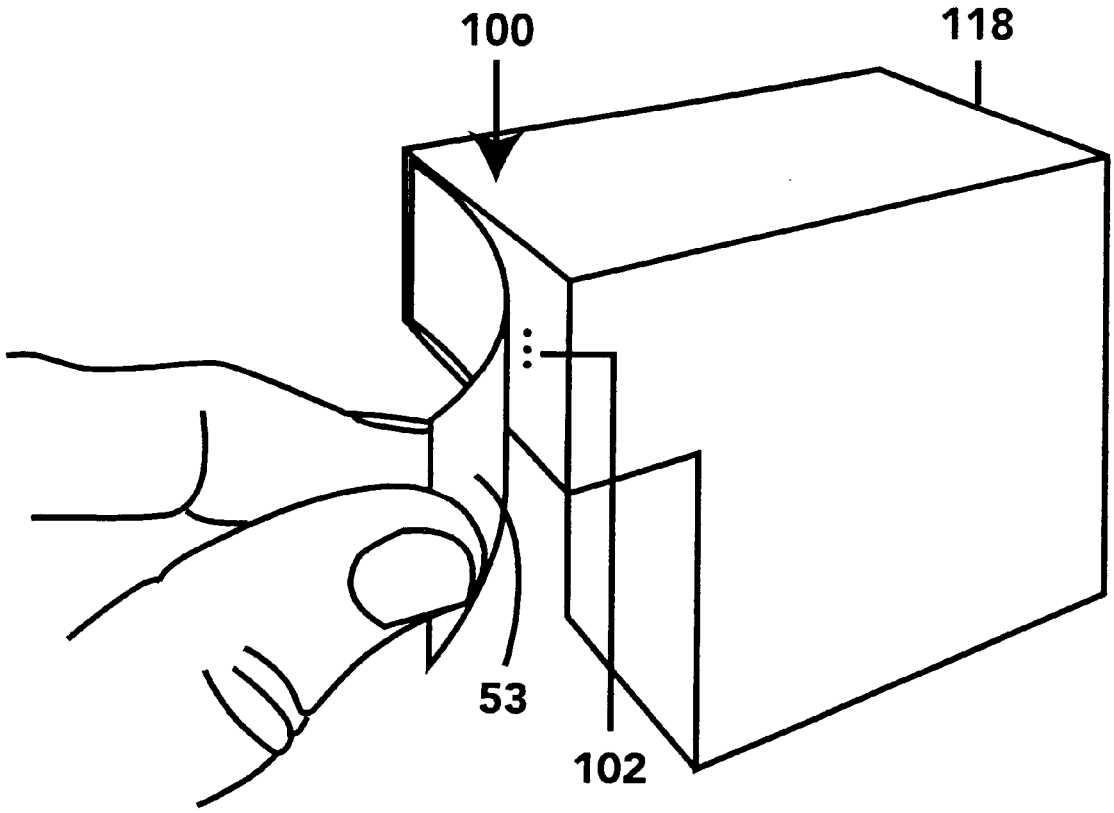
FIG. 3 is a schematic perspective showing removal of the sealing component from the cartridge.

Once manufactured, the packaging of the invention is used in the same manner as the prior-art packaging. After storage of the packaging, which now can be for a longer period than the prior-art packaging because of the inhibition of harmful bubble growth under the sealing component, the end user grasps the packaging and tears it open. Reference is now made to FIG. 3, which is a schematic perspective view of a print cartridge 118. Before installing the cartridge in a printer the user removes the sealing component 53 from the nozzle orifices 102. Because of the practice of the invention, the seal of the sealing component 53 has been preserved and bubbles have not grown under the sealing component, so the print head 100 has not lost any of its function during storage.

While this invention has been described with reference to certain specific embodiments and examples, it will be recognized by those skilled in the art that many variations are possible without departing from the scope of this invention, and that the invention, as described by the claims, is intended to cover all changes and modifications of the invention which do not depart from the scope of the invention.

What is claimed is:

1. A packaged printer cartridge comprising:

an inkjet printer cartridge having a printhead with a nozzle plate and a plurality of nozzle orifices in the nozzle plate, and further having an ink reservoir chamber in fluid communication with the nozzle orifices of the nozzle plate;

a sealing component having an inner surface adhesively attached to the nozzle plate to provide a barrier across the nozzle orifices during shipping or storage of the printhead;

a shipping container with walls to enclose the printer cartridge such that a space is created between the walls and the printer cartridge for holding gas, wherein the walls include a material to inhibit the passage of the gas located in the space; and water vapor in the space combined with the gas to inhibit the growth of gas bubbles between the inner surface of the sealing component and the nozzle orifices.

2. The packaged printer cartridge of claim 1 wherein the water vapor is of a quantity such that the water vapor in the gas is at saturation.

3. The packaged printer cartridge of claim 1 wherein the shipping container contains liquid water of a sufficient quantity to maintain the water vapor in the gas at saturation.

4. The packaged printer cartridge of claim 1 wherein the gas is atmospheric air.

5. The packaged printer cartridge of claim 1 wherein the shipping container contains a water absorbent material containing water in a sufficient quantity to maintain the water vapor in the gas at a sufficient concentration to inhibit the growth of gas bubbles between the sealing component and the nozzle orifices.

6. The packaged printer cartridge of claim 1 which includes a side pocket inside of the container for holding water, wherein water vapor from the side pocket is in communication with the gas in the space.

7. A method for inhibiting growth of gas in an inkjet print cartridge during shipment or storage of the print cartridge prior to installation on a printer comprising:

providing the inkjet print cartridge with a reservoir holding liquid ink, the reservoir connected to nozzle orifices in a nozzle plate;

attaching a sealing component to the nozzle plate to provide a barrier over the nozzle orifices;

enclosing the print cartridge with the sealing component in a shipping container having walls to define an enclosed space around the print cartridge and to inhibit the passage of gas; and introducing water vapor into the shipping container in a sufficient amount to inhibit the growth of bubbles in the vicinity of the nozzle orifices.

8. The method as in claim 7 wherein the water vapor is introduced into the shipping container in a quantity such that the water vapor in the enclosed space is at saturation.

9. The method as in claim 7 which includes introducing liquid water into the shipping container in a quantity sufficient to maintain the water vapor in the enclosed space at saturation.

10. The method of claim 9 which further includes providing a pocket in the shipping container for holding a supply of liquid water, and dispersing water vapor from the supply of liquid water throughout the enclosed space.

11. The method of claim 9 which further includes providing a water absorbent material in the shipping container for holding a supply of liquid water, and dispersing water vapor from the supply of liquid water throughout the enclosed space.

* * * * *